US005302993A

United States Patent [19]

Farling et al.

[11] Patent Number: 5,302,993

[45] Date of Patent: Apr. 12, 1994

[54] MICROWAVE-HEATED FILM PROCESSING APPARATUS

[75] Inventors: Duane J. Farling, Webster; Steven M. Bryant, Holley, both of N.Y.

[73] Assignee: Eastman Kodak Company, Rochester, N.Y.

[21] Appl. No.: 823,921

[22] Filed: Jan. 22, 1992

[51] Int. Cl.[5] ..... G03D 13/00

[52] U.S. Cl. ..... 354/299; 354/324

[58] Field of Search ..... 354/324, 298, 299, 331, 354/336; 134/64 R, 64 P, 122 R, 122 P

[56] References Cited

U.S. PATENT DOCUMENTS

| | | | |
|---|---|---|---|
| 3,149,550 | 9/1964 | Lohse et al. | 354/299 |
| 3,744,394 | 7/1973 | Firth | 354/299 |
| 3,886,576 | 5/1975 | Stoffel | 354/317 |
| 3,936,854 | 2/1976 | Smith | 354/299 |
| 4,884,093 | 11/1989 | Bohmig | 354/299 |
| 5,194,887 | 3/1993 | Farling et al. | 354/297 |

FOREIGN PATENT DOCUMENTS

0417782A2 3/1991 European Pat. Off. .

*Primary Examiner*—D. Rutledge

*Attorney, Agent, or Firm*—Paul A. Leipold

[57] ABSTRACT

A compact developing apparatus that can quickly modify processing chemistries is disclosed. A web coated with a photograph emulsion or other photosensitive material forms one wall of a processing chamber and processing chemicals are introduced sequentially into the stationary chamber. The heating of the processing chemicals to their required temperatures is accomplished by applying microwave energy to the chemicals upstream of the chamber. The heating is controlled by a programmed digital computer to provide forward and backward feedback control of the microwave output in response to temperature and flow rate measurements.

1 Claim, 8 Drawing Sheets

MICROWAVE-HEATED FILM PROCESSING APPARATUS

CROSS REFERENCE TO RELATED APPLICATIONS

This application contains subject matter in common with U.S. applications entitled "Apparatus for Testing Photographic Emulsions" U.S. Pat. No. 5,194,887 and "Single Unit Apparatus For Chilling, Drying and Incubating Photographic Emulsions" filed on even date herewith.

BACKGROUND OF THE INVENTION

1. Field of the Invention

The invention relates to an apparatus for developing photographic emulsion. In the apparatus of the invention a web coated with a photographic emulsion or other photosensitive material forms one wall of a processing chamber and processing chemicals are introduced sequentially into the stationary chamber. The heating of the processing chemicals to their required temperatures is accomplished by applying microwave energy to the chemicals upstream of the chamber.

2. Background Art

The commercial production of photographic film involves the preparation of very large batches, on the order of 1500 L, of chemically complex photographic emulsions whose batch-to-batch variation in photographic response be kept to a minimum. The photographic characteristics of an emulsion (contrast, speed, reciprocity, maximum density and fog) are commonly referred to as its sensitometric properties. Currently sensitometric properties are assayed on each batch of emulsion by actually running a portion of the emulsion through the commercial scale coating machinery, to provide a section of coated web, exposing the emulsion in a controlled fashion in a sensitometer, developing the image by conventional processing bath technology, and measuring the image in a densitometer. The developing of the image in conventional processing baths is very time-consuming, wastes large amounts of materials, and is almost completely inflexible to changing parameters.

An apparatus wherein a section of film could be developed in a small space with complete flexibility as to time, temperature and processing chemicals would obviate all of the problems of the earlier method. To provide such an apparatus one needs a developing chamber of small working volume and one needs to be able to control its temperature quickly and precisely. The art provides several examples of small working volume chambers for developing film.

U.S. Pat. No. 3,149,550 (Lohse et al.) discloses an apparatus for developing film wherein there is provided a minute processing chamber defined by the emulsion side of an exposed photographic film and a platen closely spaced in parallel relationship thereto. The spacing between the platen and film is preferably sufficiently close so that the processing liquids introduced therebetween are held within the chamber by capillary force. Successively small amounts of processing fluids are passed to the processing chamber, with each succeeding fluid serving to supplant the preceding fluid in the chamber. Means are provided for delivering processing fluid to the processing chamber through opening in the platen. The distance between the plane of the platen surface and the plane of the film engaging surface of the frame is in the preferred embodiment from about 0.01 to 0.030 inch. The apparatus is preferably provided with a heater block supporting the platen and carrying a fluid passage which is in communication with the central opening of the platen. The heater block may or may not be integral with the platen. A heating element preferably is embedded within the heater block. The fluid supply passageways within the heater block are of a sufficient length to preheat the processing fluids.

U.S. Pat. No. 3,744,394 (Firth) discloses an apparatus for processing film wherein a latent image on a sheet or strip of film is processed to produce a dry, developed film by positioning it between a pair of spaced platens. The one platen is moved into contact with the film and then the other platen is moved into position so as to clamp the film therebetween. The other platen is also provided with a resilient frame member which provides a seal with respect to the support side of the film. A recess in the one platen is interconnected to the processing solutions through a metering valve so that each solution is moved into the recess in a required order so as to develop the latent image area. Each platen is provided with a cavity in which a foil heating element is arranged in contact with the cavity surface. With this arrangement, the flow of solution is maintained at a generally consistent and uniform temperature from the point of introduction into the recess to the point at which it is withdrawn after processing has been completed.

U.S. Pat. No. 3,886,576 (Stoffel) discloses an apparatus for developing a film insert on an aperture card. The apparatus comprises a sealing member on a receptacle arranged to contact a portion of the card bordering the aperture to form a processing chamber that confines processing solutions to an area on the card including all the film insert overlying the aperture, and means for compressing the card against the sealing member to render the compressed portion of the card substantially impervious to processing solution. The apparatus further includes means for supplying processing solutions to a processing chamber including all the film member overlying the aperture. The patent does not describe heating means, but observes "Because of film processing considerations which are well known in the art, it may be necessary to provide the developer and fixer tanks with a solution heater assembly (not shown) for maintaining these fluids at a predetermined temperature."

U.S. Pat. No. 3,936,854 (Smith) discloses an apparatus for developing photosensitive material. The apparatus comprises two members between which the material is clamped during the development process. The first member which is fixed, has an open-end chamber that is interconnected to two sources of air under pressure and to a reservoir for at least once processing fluid. This chamber is also provided with two concentrically arranged sealing means for retaining the processing fluid in proper relation to the image area being developed when the material is clamped between the two members. The second member is movable relative to the first member for clamping the material therebetween via the sealing means. The second member is provided with a recess in which a heater member and a transparent plate are mounted and each of which engages the facing surface of the support. The heater member is provided with a duct through which hot air can be circulated or in which a heating element or coil can be arranged. The heat transferred to the member is conducted to the support by the portion in contact therewith and also to the transparent plate, the surface of which also engages the surface of the support.

U.S. Pat. No. 4,884,093 (Bohmig) discloses an apparatus for developing a film sheet of a film punched card. The apparatus comprises a developing chamber limited on one side by the emulsion coating of the film and on the other by a chamber which is formed from a metal block having a heating cartridge embedded in it. Temperature is maintained accurately and invariably.

There is one disclosure of a heating system that provides a fast, dynamic response. European published application 417782 (Gebo) discloses a control system for a process variable. An example is given utilizing the control system to regulate a microwave generator to provide precise heating of a flowing fluid. The reference states that the control system may be utilized in a process for coating photographic paper or film.

The art provides apparatus for repetitive developing processes under constant conditions. The cited examples are adapted for a developing operation performed on a strip of material that is moved intermittently. The use of a microwave heat source in combination with a developing chamber to provide a developing apparatus that is small and versatile is not disclosed or suggested.

The film developing art addresses the need for providing processing chemicals at an elevated temperature by (1) heating the processing chamber (Lohse, Firth, Smith and Bohmig) or (2) heating the processing chemicals before they enter the chamber (Lohse and Stoffel). When the chamber is complex or involves a large mass of metal, a system that heats the chamber is slow to respond to a requirement for different temperatures. It is therefore suited to repetitive processes under constant conditions; it is unsuited to procedures such as test paradigms, where temperatures must be frequently changed. Heating the processing chemicals apart from the processing chamber allows one to change temperatures—provided that the chamber and connecting plumbing incorporate minimal amounts of thermally conductive material—but the means for heating disclosed in the film processing art, namely heating blocks and heating baths, require separate blocks or baths for each combination of chemical and temperature. An apparatus to be used for testing various emulsions that require different development temperatures would be impractically large. Moreover, the use of baths leads to degradation of chemicals that are maintained at elevated temperatures.

There thus exists a need for a compact developing apparatus that can quickly modify processing chemistries, particularly with respect to temperature.

SUMMARY OF THE INVENTION

It is an object of the present invention to provide a compact developing apparatus that can quickly modify processing chemistries, so that a wide variety of photosensitive materials can be processed.

It is a further object of the invention to provide a processing apparatus adapted for a developing operation performed on a strip of material that is moved intermittently, rather than continuously.

It is a further object of the invention to provide a processing apparatus that provides very precise and very responsive control of the chemistry of a developing process.

It is a further object of the invention to provide an apparatus that minimizes the degradation of processing chemicals by allowing them to be stored at relatively low temperatures.

The invention in its broadest form relates to an apparatus for the fluid processing of a photosensitive material comprising:

(a) a pair of platens, which, together with a coated web, form a processing chamber in which one wall of the chamber is provided by a photosensitive material-coated surface of the coated web. The chamber has provision for the flow of processing chemicals;

(b) a heating unit, comprising means for measuring temperature before and after a control point and for measuring flow rate, a source of microwave energy to provide thermal energy at the control point, and a programmed digital computer to provide forward and backward feedback control of the microwave source based on the temperatures and flow rate;

(c) means for transporting processing chemicals between the heating unit and the processing chamber; and (d) means for controlling the temperature and flow of the processing chemicals to the processing chamber.

In a more particular form the invention relates to an apparatus comprising:

(a) a first platen having a cavity on one planar surface and a pair of ducts at opposite ends of the cavity penetrating the platen to provide fluid communication with the ends of the cavity;

(b) a second platen;

(c) means for urging the two platens against opposite faces of a web coated on one face with a photosensitive material. The second platen is in contact with the uncoated surface of the web and the cavity-containing surface of the first platen is in contact with the coated surface of the web. The second platen is aligned so as to urge the coated surface of the web into sealing contact with the planar surface of the first platen at the perimeter of the cavity to provide the processing chamber;

(d) a microwave heating unit the output from which is controllable within ±1° C., preferably ±0.1° C., from 20° to 60° C.;

(e) means for transporting processing chemicals between a source, the heating unit, the processing chamber, and a waste drain; and (f) a computer supervised process monitor and controller.

The means for urging the platens is preferably a plurality of pneumatic cylinders.

In a preferred embodiment the apparatus is further refined so that the second platen provides a raised, resilient pattern on one planar surface, said pattern being of overall length and width smaller than the first platen and minimally larger than the cavity on the first platen. The pattern is of uniform elevation above the surface of the second platen and is aligned so as to urge the coated surface of the web into sealing contact with the planar surface of the first platen at the perimeter of the cavity. The second platen is preferably moveable by a plurality of pneumatic cylinders against the first, cavity-containing platen, which is fixed.

BRIEF DESCRIPTION OF DRAWINGS

These and other objects, features and advantages of the invention will be more readily understood from the following detailed description when read in conjunction with the accompanying drawings, in which.

DESCRIPTION OF PREFERRED EMBODIMENTS

In order to provide a system that is quickly adaptable to processing differing photosensitive materials, it is desirable to have an apparatus that has a single chamber in which all chemistry can be performed. Because the chemistry involves different solutions and different temperatures, the chamber must be chemically inert and must have low thermal inertia. Art-known materials for fabricating processing chambers and platens such as stainless steel and chromium plated metals are chemically inert, but have high thermal inertia. Insulating materials e.g. polymers such as PTFE (Teflon TM) are suitable. A small processing chamber minimizes chemical consumption and cleanup.

The two means employed in the art for heating processing chemicals before they reach the chamber are heating baths and heating blocks. In the first instance a separate bath is needed for each reservoir of chemicals that has a different optimum temperature, and the chemicals are stored for extended periods at elevated temperatures. In the second instance the processing chemical is stored at ambient temperature and heated to the desired temperature on demand. This would be the more desirable approach if it were not for the block. The block must be of sufficient mass to function as an effective heat sink and of a size to allow a sufficient path length for a chemical entering at ambient temperature to come to equilibrium at the desired elevated temperature. Both of these approaches lead to impractically large apparatus for simple testing.

A solution to the heating problem is a means for heating that delivers a large amount of thermal energy in a small space without any latent heat, i.e. when the energy source is regulated the fluid temperature response is essentially instantaneous. A microwave impinging on a fluid in a microwave-transparent flow system having a feedback, and, ideally, a feed-forward, control provides such a means.

The instant invention combines an inert, insulating processing chamber, a series of supply reservoirs of processing chemicals at ambient temperature and a microwave heating system that, for the first time, allows complete flexibility in processing photosensitive materials.

Figure 1:
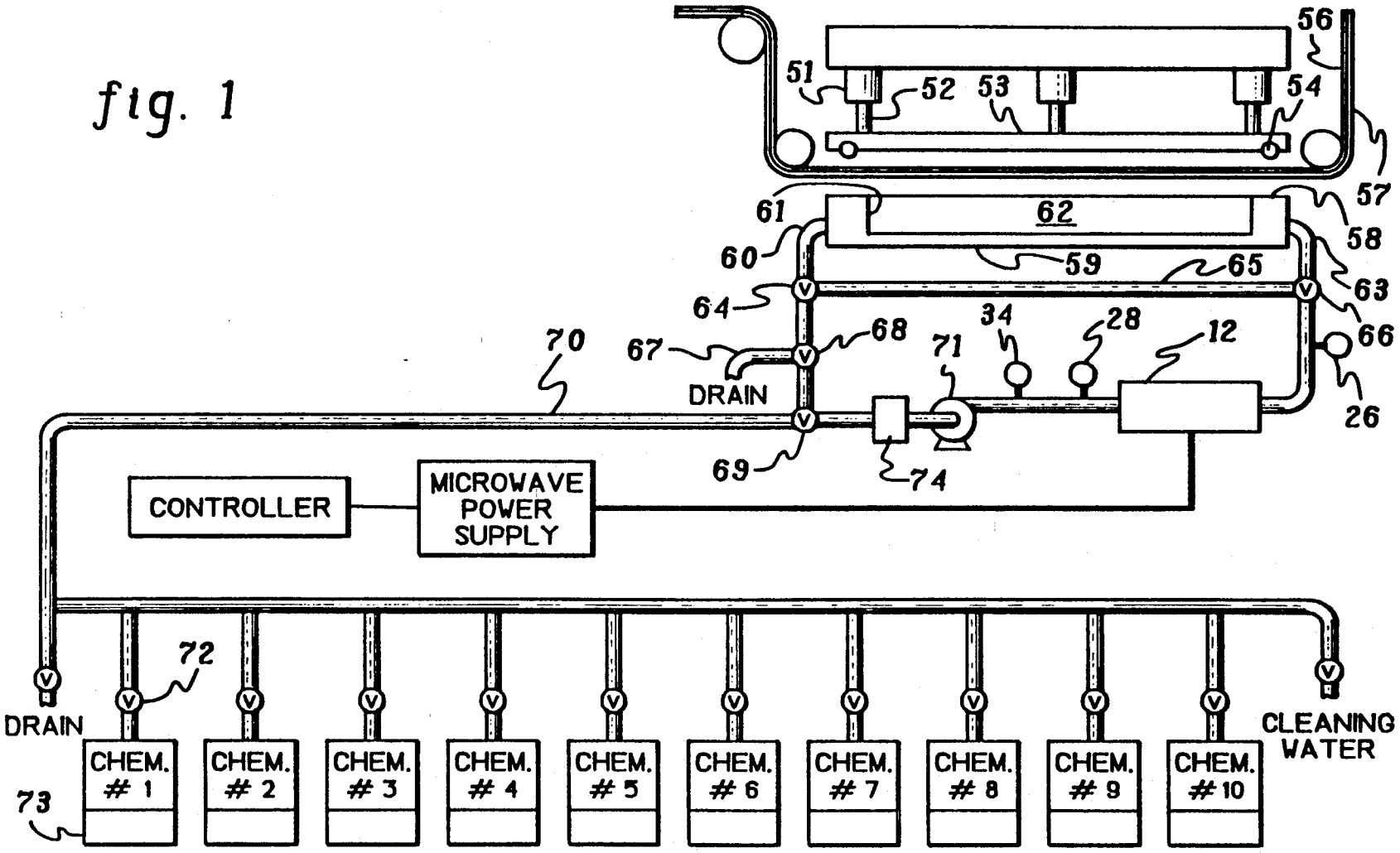
FIG. 1 is a schematic of a vertical section of the apparatus of the invention.
Figure 2:
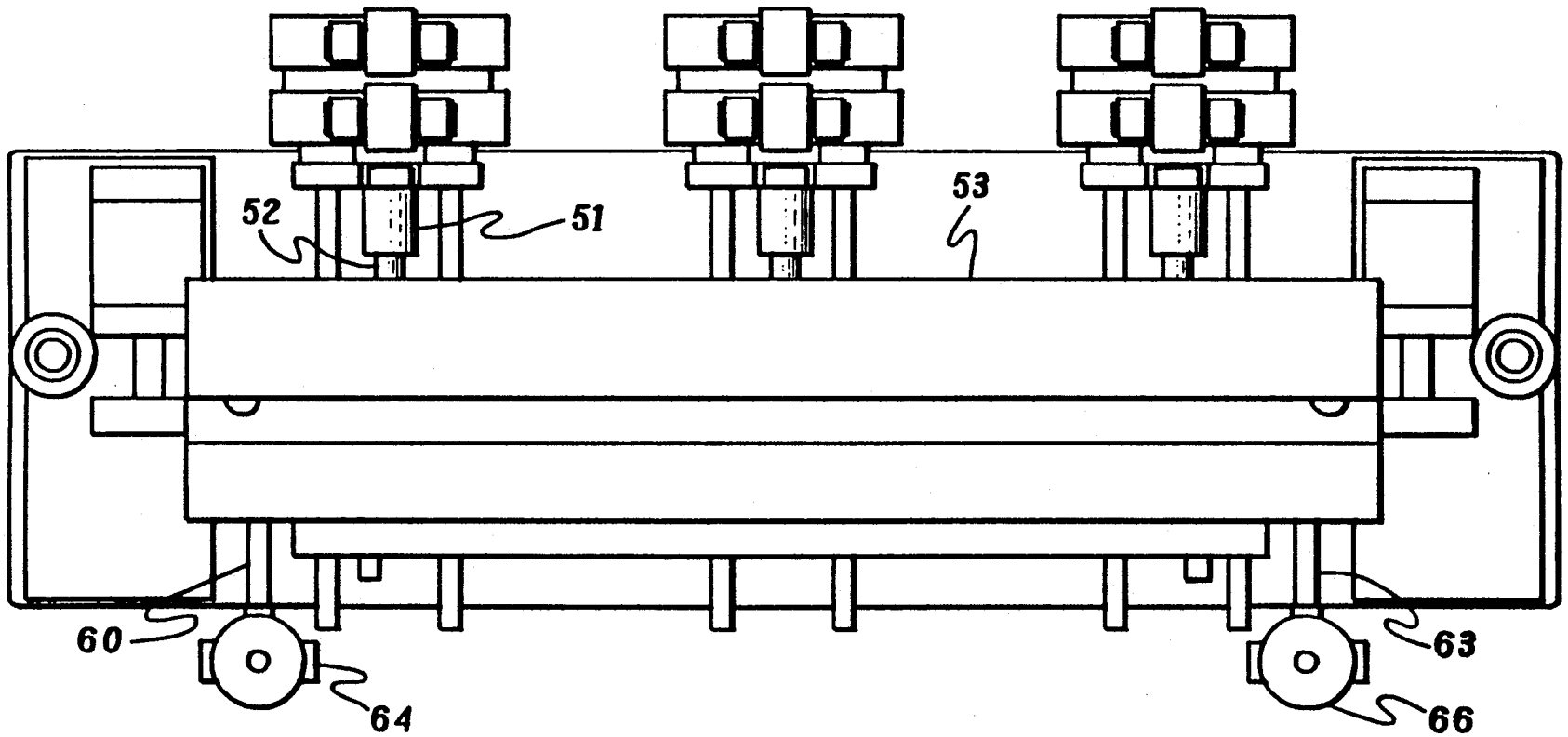
FIG. 2 is a detailed vertical section of the processing chamber portion of the apparatus.
Figure 3:
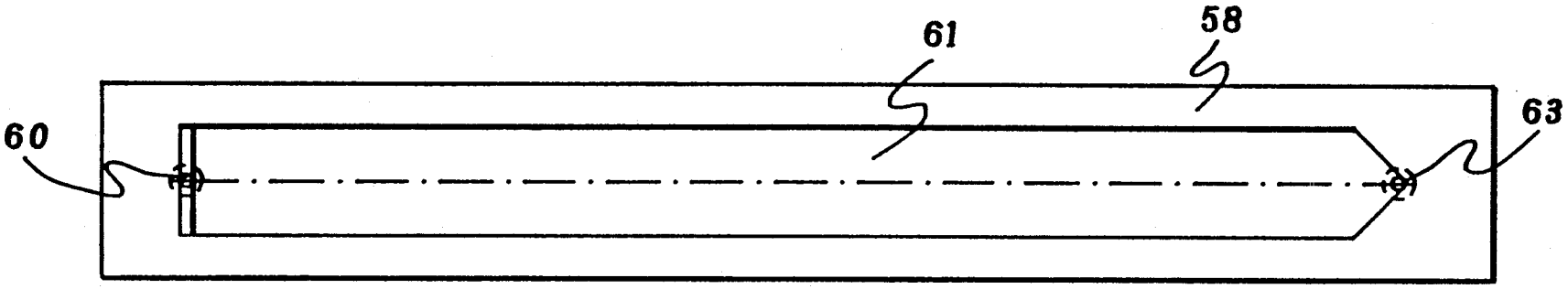
FIG. 3 is a detailed horizontal view of the surface of a first platen.
Figure 4:
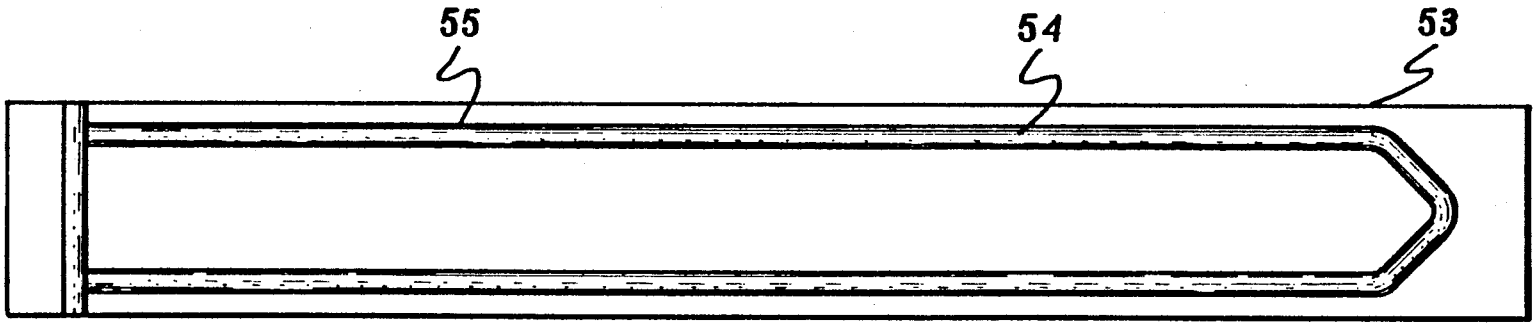
FIG. 4 is a detailed horizontal of the surface of a second platen.

The apparatus in one embodiment is illustrated schematically in FIG. 1. A web 56, coated on one face with a photosensitive material 57 passes between two platens 53 and 59. The platens may be of any material or combination of materials that is thermally insulating and mechanically stable under the forces necessary to provide a seal between the photosensitive material 57 and the lower platen 59. A block of PTFE or a metal block having enough thickness of PTFE to function as an insulator can be used. Other polymers may also be used in place of PTFE, but the range of chemicals to which they may be exposed is narrower. The platens are shown in somewhat more detail in FIGS. 2, 3, 4, and 11.

In operation the hydraulic cylinders 51 acting on the shafts 52 displace platen 53 downward, forcing web 56 and coating 57 against the face of platen 59. A raised, resilient pattern 54, which is smaller than platen 59 but marginally larger than a cavity 61 in platen 59, provides a localized pressure on the web just outside or at the perimeter of the cavity 61 to create a seal between the photosensitive material 57 and the platen face 58. The raised, resilient pattern is preferably provided by an O-ring or gasket 54 fitted in a corresponding channel 55 in platen 53. An alternative embodiment would provide an elevated rim of cavity 61 and a flat face of platen 53: it is less desirable because the integrity of the elevated rim would be critical to the sealing of the chamber. The O-ring is preferably an elastic polymer such as neoprene optionally coated with PTFE.

Once a seal has been made, defining a chamber 62, a processing fluid is drawn by pump 71 from a supply 70, pumped past flow detector 34 and temperature detector 28 through microwave cavity 12, past temperature detector 26 through duct 63 and into processing chamber 62. A heat exchanger 74 supplied with chilled water is interposed ahead of the pump 71 to ensure that the fluid will always be at a temperature lower than desired when it enters the microwave applicator 12. The fluid passes through the chamber 62, out through duct 60 and valve 68 to drain 67. An optional, but preferred, additional loop including valves 64 and 66 and shunt 65 allows bypass of the chamber when additional temperature control is desired. Thus valves 68 and 69 may be opened to drain 67 and supply 70 respectively, valves 64 and 66 set toward shunt 65 and fluid pumped from supply 70 to drain 67. Valves 68 and 69 are then set for internal cycling and fluid is pumped in a loop through the microwave cavity 12 and the shunt 65 until it is ready for use. When the temperature is within desired limits, valves 64 and 66 are set towards ducts 60 and 63 and fluid is pumped in a loop through chamber 62. When the appropriate time and volume has been reached, valves 68 and 69 are reset for supply 70 and drain 67 and the chamber 62 flushed with a second fluid, commonly a wash. This cycle is repeated with or without the involvement of the shunt 65 for each successive processing fluid. A single liquid, usually referred to as a monobath, can be used to develop the latent image on a photographic material, or developer and fixer solutions, as well as water, or various processing liquids can be introduced sequentially into the apparatus to develop a photographic latent image. The term "processing fluid" is meant to include all of these.

As shown in FIG. 1, the supply port 70 is coupled to the individual reservoirs 73 for processing fluids by conduits which are controlled by valves 72. The number of reservoirs illustrated is ten, but it will be appreciated that the number is not restricted to ten and in practice will be a function of the demand for various fluids.

The valves 64, 66, 68, 69 and 72 are conventional and their control by computers is well-known in the art.

The terms "process", "develop", "processing", "developing", etc. are considered to be synonymous as used throughout the specification and claims. In the same manner, "photosensitive material" is meant to include photographic material in either the transparent (e.g. film) or opaque (e.g. paper) form.

Figure 5:
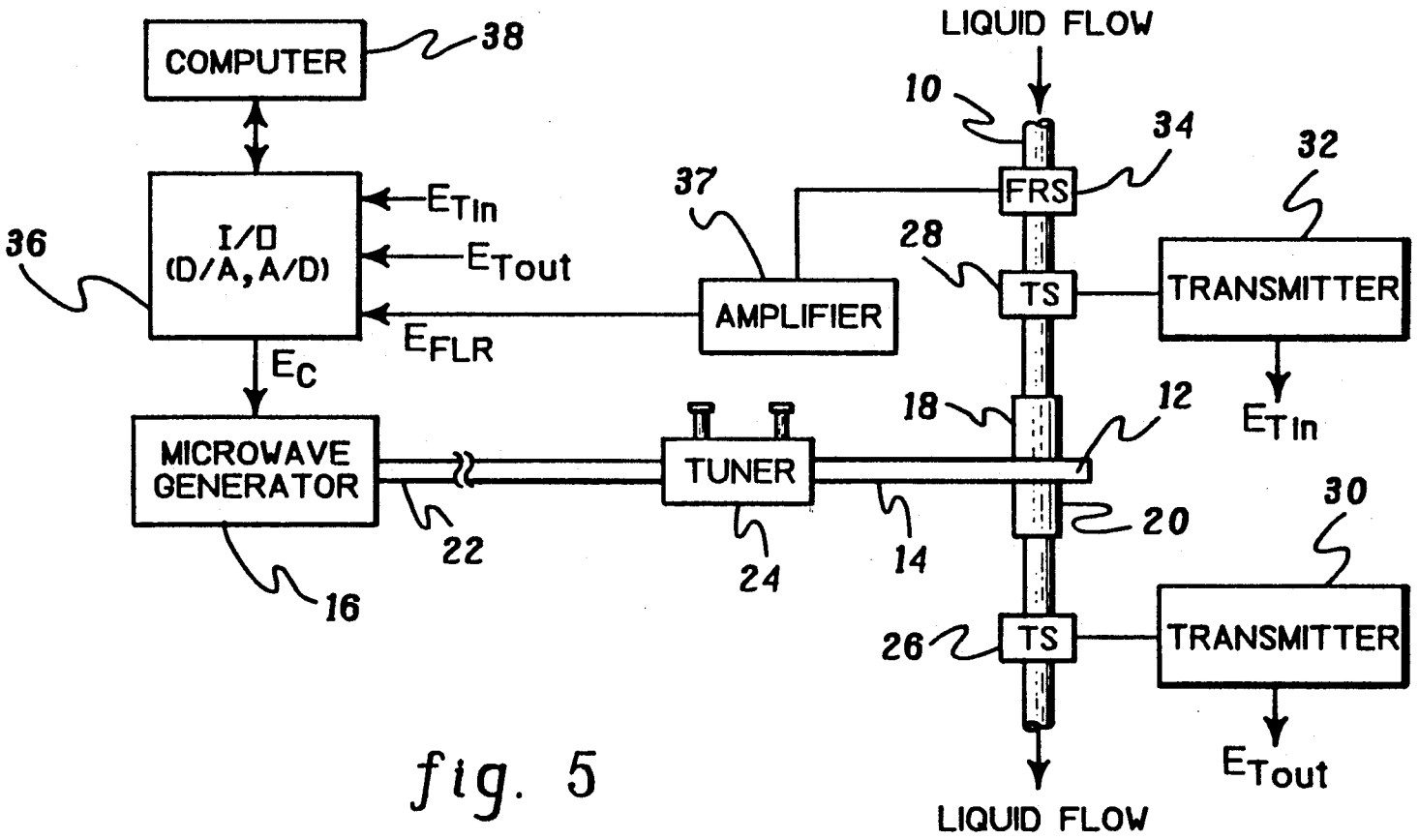
FIG. 5 is a detailed schematic of the microwave heating segment of the apparatus.

The configuration of the microwave heater is shown in FIG. 5 in somewhat more detail.

The processing fluid flows through a plastic pipe 10 past a temperature control point 12 in a wave guide applicator section 14, which applies microwave energy from a microwave generator 16 to heat the fluid at the control point. Conductive couplings 18 and 20 are used to seal the applicator 14 against the escape of microwave energy. The plastic pipe 10 carrying the fluid extends through these couplings.

The applicator 14 is tuned to the frequency of the microwave generator. For example, a suitable generator is made by Gerling Laboratories of Modesto, Calif., USA and produces an output frequency of 2.45GHz. Other frequencies may be used, for example, when larger waveguides are practical. The microwaves are transmitted by a wave guide 22 to the applicator 14. The applicator 14 is tuned by a slug tuner 24. Such tuners are shown in U.S. Pat. No. 4,689,459. The microwave generator is controlled by a control signal (for example, a voltage which may vary from 0 to 1 volt) which changes the microwave energy supplied to the applicator 14 from 0 to 3 KW. The microwave heating unit is controllable within ±1° C. and preferably controllable within ±0.1° C. from 20° to 60° C.

The temperature of the incoming fluid is measured ahead of the control point and also after the control point 12 by temperature sensors 28 and 26, which are close enough to the control point that time delay between temperature measurements is minimal and the temperature at the sensor 26 is substantially the same as the temperature of the fluid at the control point. Thermistors, which are responsive to the temperature of the liquid in the pipe, are suitable sensors. The transmitters 30 and 32 contain amplifiers which produce analog outputs, for example, currents (e.g. from 4 to 20mA) proportional to the temperature measured by the thermistors 26 and 28. These analog outputs are indicated as $E_{Tin}$ and $E_{Tout}$.

A flow sensor 34 (FRS) is also disposed to sense the flow rate of the liquid through the pipe 10. The output of the sensor 34 is amplified in an amplifier 37 and produces the flow rate signal, $E_{FLR}$, which may also be a 4 to 20 ma current signal.

Figure 6:
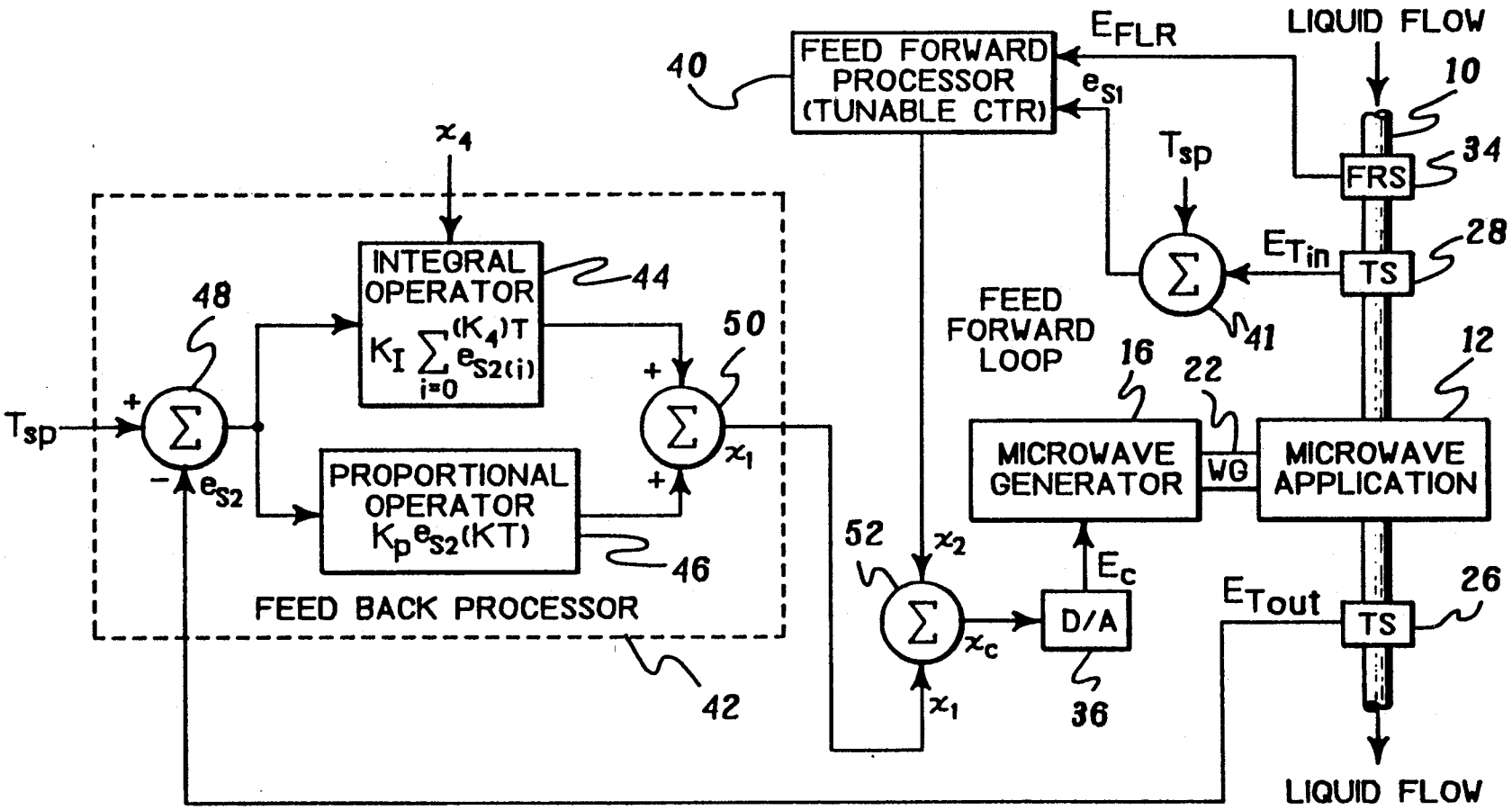
FIG. 6 is a functional block diagram illustrating in greater detail than FIG. 5 the adaptive process control of the microwave heating system.

The signals $E_{Tin}$, $E_{Tout}$ and $E_{FLR}$ are applied to an input output (I/O) device 36, including analog to digital converters which digitize these signals, iteratively at a sampling rate, which may be at one second intervals. The digital signals are applied by the I/O 36 to a digital computer 38 which implements the control system which is schematically illustrated in FIG. 6. The computer communicates through the I/O 36 with the microwave generator and provides the control signal $E_c$. This control signal is an analog signal, which as indicated above may vary between 0 and 1 volt. The microwave generator has suitable amplifiers which use this control signal $E_c$ to control a magnetron therein which produces the microwave energy. A digital to analog converter in the I/O 36 provides the analog control signal $E_c$ to the microwave generator 16. The I/O 36 includes memory (e.g., latches and other digital logic) for holding signals between sampling times. The computer 38 is programmed to carry out the processes or algorithms needed to perform feedback control and feedforward control, which are shown in the flow charts (FIGS. 7, 8, 9, and 10 hereof).

The term process is used here with reference to the flowing fluid temperature control process. The term process also refers to computational processes as will be apparent from the context of the description as it proceeds. The microwave generator has a constant transfer function and can vary its output energy over a multikilowatt range. Absorption of the microwave energy by the bulk of the fluid is very rapid so that fast temperature transients can readily be followed and corrected by the energy supplied from the microwave generator.

FIG. 6 illustrates the controller. This controller provides feedforward control in response to the temperature measured ahead (upstream) of the control point 12 by the sensor 28. The system provides feedback control in response to the temperature measured by the sensor 26 after (downstream) the control point. In other words, there is a feedforward controller or control loop and a feedback controller or control loop. The system is designed to control the temperature at the control point to a certain set point temperature $T_{SP}$. The set point is adjustable by the computer 38. The I/O 36, A/D may provide a 12 bit conversion for high accuracy and precise control.

The feedback loop utilizes a feedback processor 42 which has an integral and proportional response which is illustrated as the summation operator 44 and the proportional operator 46 thereof (an integral function). The set point signal $T_{SP}$ is compared or summed as shown at 48 with the temperature signal $E_{tout}$ from sensor 26 to provide an error signal ($e_{s2}$). This signal, $e_{s2}$, is subjected to the proportional operator 46 and the integral operator 44 and summed at 50 to provide the feedback processor output $x_1$. $x_1$ can be positive or negative and respectively either adds to or subtracts from the output of the feedforward loop to control the amount of energy produced by the microwave generator 16, which is applied via the wave guide 22 to the microwave applicator 12 at the control point. The response of the feedback controller may be written as $$x_1(kT) = K_p e_{S2}(kT) + K_I T \sum_{i=0}^{k-1} e_{S2}(iT) \quad (1)$$

where T is the sampling interval (1 sec in this example), k denotes the kth sample and the other terms are defined above and $K_P$ and $K_I$ are tuning constants, discussed below.

The feedforward processor has a proportional response in accordance with the control function of the process. This response is to the error signal $e_{s1}$ obtained from the summation of the signal from the temperature sensor 28, $E_{Tin}$ and $T_{sp}$ at 41. This response may be expressed as follows:

$$KW_{out} = a\left[\frac{C_p W \Delta T}{K_m}\right] \quad (2)$$

where a is the gain of the control function, $C_P$ is the specific heat of the fluid in the pipe 10; W is the flow rate of the fluid in pounds per minute, T is the temperature correction needed to bring the temperature at the control point 12 to the set point; and $K_m$ is a constant.

The output of the feedforward controller $x_2$ is a fractional value proportional to the desired output power from the microwave generator. The above equation for KW can be used to calculate the necessary output from the feedforward processor 40. In practice, the relationship between microwave generator input and output may be nonlinear. Therefore, the best temperature control will be achieved when this nonlinearity is taken into account in determining $x_2$. In other words, the system compensates for nonlinearity in the microwave generator. The output from the feedback controller 42, $x_1$, may add to or subtract from the feedforward controller output $x_2$. $x_1$ and $x_2$ are summed at 52 to provide a control output $x_c$. This control output is converted from a digital signal into the analog signal $E_c$ in the digital analog converter D/A of the I/O 36 as shown in FIG. 6. The analog output $E_c$ may vary from 0 to 1 volts (or other range depending upon the interface of the microwave generator) and controls the power generated by the microwave generator 16 so as to accurately and precisely regulate the temperature at the control point. The feedforward loop is responsible for changing the temperature at the control point by varying the amount of energy produced by the microwave generator 16. The system operates during transient changes and also adapts to changes in the process. For example, if different batches of processing fluid have different specific heats, the initial control function will be incorrect. This control function is tuned by changing gain a. The gain can also be changed to correct for other conditions such as a change in the frequency of the output of the microwave generator which may change the amount of energy transmitted to the fluid, which ultimately changes the controlled temperature. The microwave generator has negligible dynamics and responds substantially as a constant gain device.

The error in the temperature (after the control point) is detected by the sensor 26 and further corrections are effected by the feedback processor 42. The combined output from both processors 40 & 42 makes up the input $x_c$ to the microwave generator 16.

Figure 7:
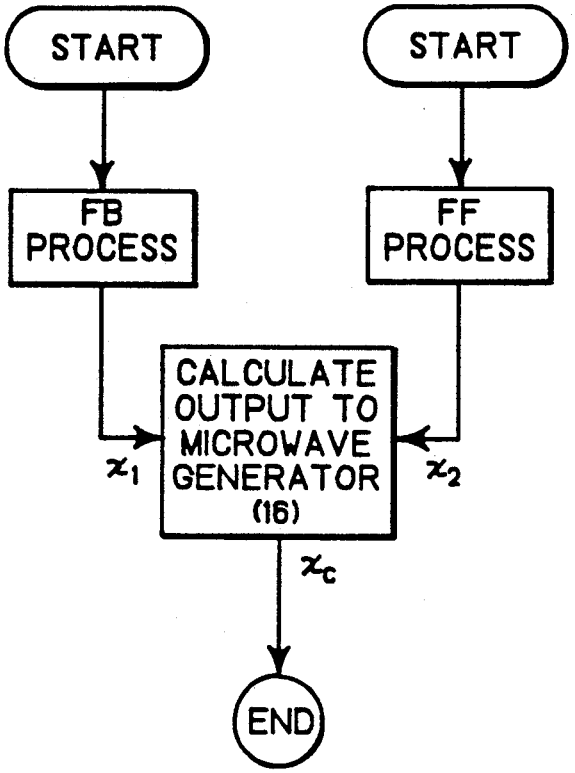
FIGS. 7, 8, 9, and 10 are flow diagrams illustrating the programming of the digital computer that implements the control of the heating.
Figure 8:
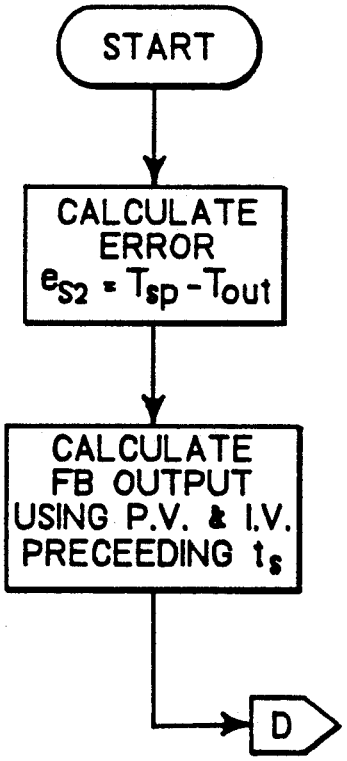

Referring to the flow charts and particularly to FIG. 7, it will be seen that the flow charts have start and end points. The start points are the beginning of each scan or iteration. The end points mean that an output value is available, for example, the feedback loop output $X_1$ and the feedforward output $x_2$. FIG. 7 shows the overall program which consists of the feedback process (FB process) and the feedforward process (FF process). The program also has a process for calculating the output to the microwave generator 16 which produces $x_c$. As discussed in connection with FIG. 6, $x_c$ is a fractional value, proportional to the maximum output from the microwave generator, and is converted into an analog signal $E_c$ for controlling the generator 16 by the D/A 36.

The first process is the calculation of the error signal $e_{s2}$. The calculation of the feedback output depends upon the tuning constants $K_P$ and $K_I$. These constants are predetermined and stored in memory. They indicate the fractional part of the error signal $e_{s2}$ used for the proportional and the integral responses, respectively. The value of $K_P$ and $K_I$ are selected in accordance with the magnitude and rate of correction desired from the system. Similar adjustment technique for proportional and integral responses in control systems are described in classical papers in the field of control systems.

The process calculates the feedback output $x_1$ using the proportional value (from the proportional operator 46) and the integral value (from the integral operator 44).

Figure 9:
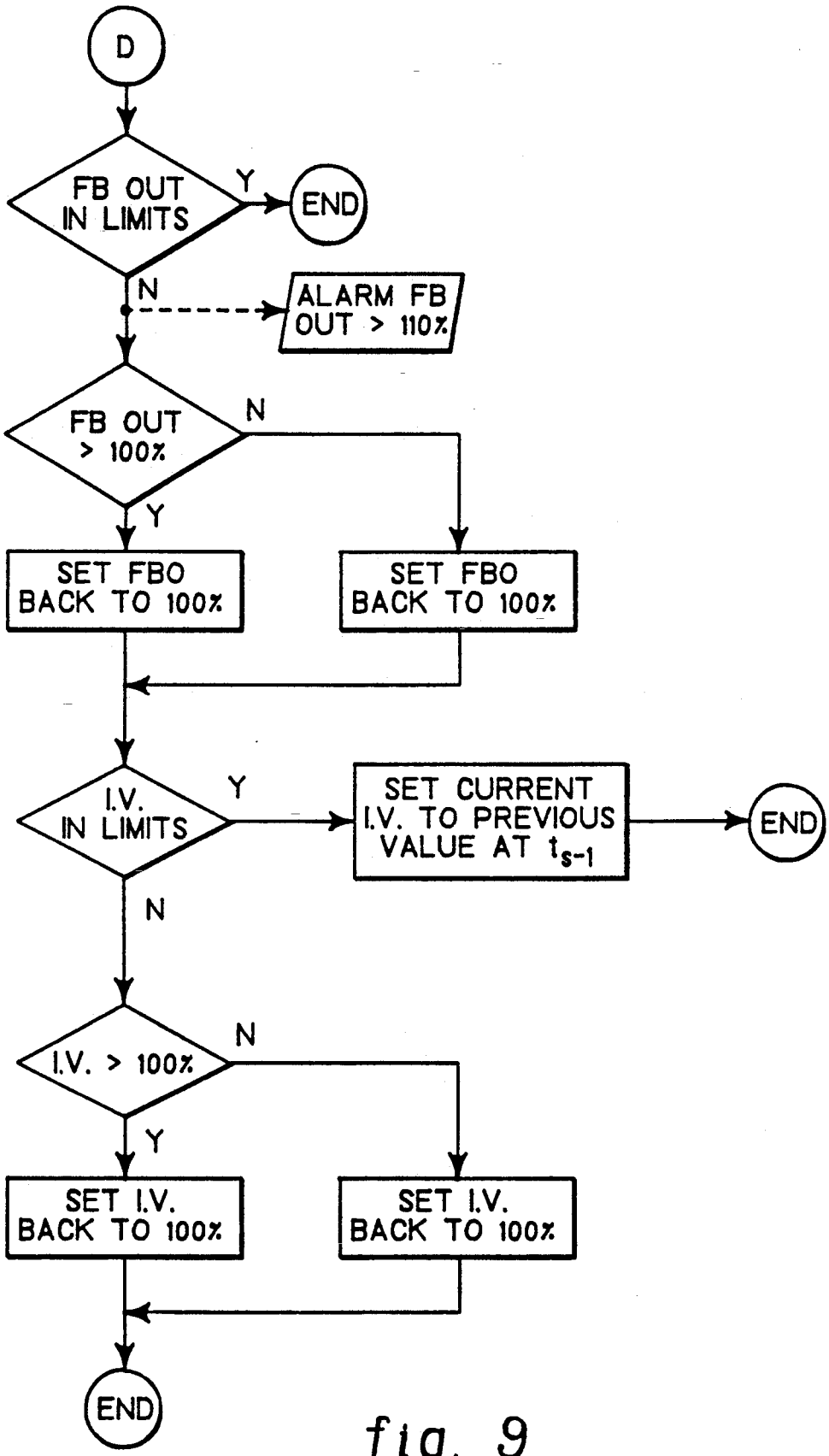

FIG. 9 is a process which detects and compensates for what is known as "reset wind-up" by which is meant that the controller has reached 100% output and cannot make further corrections. In this system this means that the microwave generator has reached either 100% output (3 kilowatts) or is at 0% output. However, error signal $e_{s2}$ may still exist for a period of time and could cause the integral value to increase to a large number which can only be reduced by having an error of opposite polarity existing generally for long periods of time. In this situation, the process is out of control. This mode of operation can be prevented as shown in FIG. 9 by limiting the controller output and particularly the integral value to the value it has at the time the controller output reaches ±100%. Should the integral value attempt to exceed ±100%, it is set back to the corresponding maximum value. Accordingly, the system must use integral values at 0 to 100% of the controller output until the integral value decreases and control is returned to the system.

The reset wind-up control program, set forth in detail in FIG. 9, makes sure that the feedback output (FBO) and the integral value (I.V.) are set back either to +100% or −100% when the feedback output is out of limits. The program proceeds by checking the feedback output to determine whether it is in or out of limits. If the feedback output $x_1$ is in limits, then it is used. A similar procedure is used for setting the integral value back to 100% or −100%. The feedback output may be greater than 100% because of changes in the integral value alone. However, the out-of-limits condition can be due to the proportional value (P.V.). The maximum integral value is used (I.V. =100%). An integral value which may also be used may be less than the maximum value to accommodate for a contribution from the proportional value. If the integral value is in limits but the feedback output is out of limits, then the current integral value which is used in determining the feedback output is set to its value at the previous sampling ($t_{s-1}$).

Figure 10:
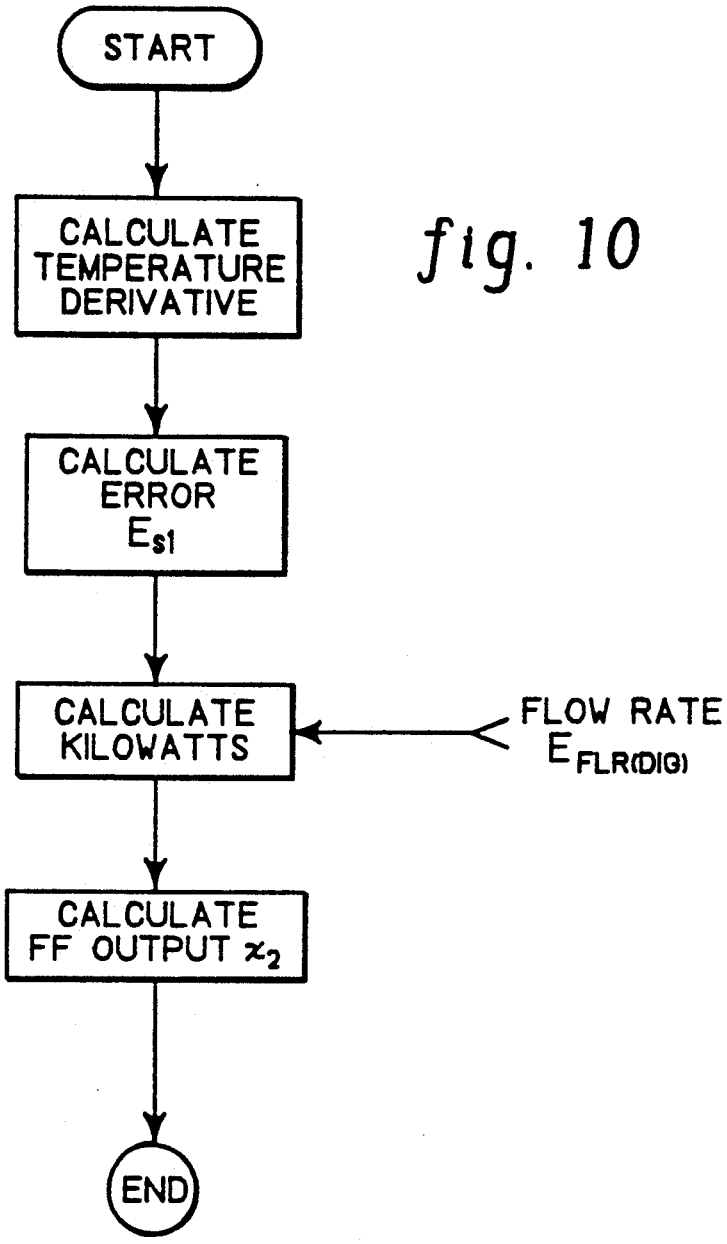
Figure 11:
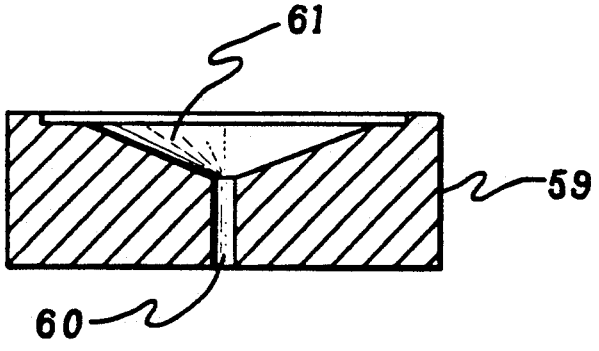
FIG. 11 is a cross-section of a first platen showing the profile of the cavity.

FIG. 10 shows the feedforward process. The feedforward process calculates the output signal $x_2$ according to the KW equation previously given and also includes a component in $x_2$ which is proportional to the rate of change of incoming temperature. Signal $x_2$ is also adjusted to compensate for any nonlinearity which may exist in the generator input-output characteristic as discussed above. When such compensation is used, it can be provided by approximating the $E_{Tout} = f(E_c)$ curve by any suitable approximation technique. A simple example is a straight line segment approximation. The feedforward process is designed to calculate the $x_2$ output in response to $E_{FLR}$, the digital value of which is obtained from the I/O 36 (FIG. 5). The tuning constant "a" is also entered. The feedforward process calculates the derivative of the temperature measured ahead of the control point 12. This is the difference in temperature as measured at successive sampling times divided by the interval between sampling times (1 second in this embodiment). The $e_{s1}$ signal may be used to calculate the temperature derivative. The $e_{s1}$ signal is calculated from the set point and $E_{Tin}$ signal as shown as shown at the summation point 41 in FIG. 6. The program then proceeds to calculate the kilowatts of microwave energy necessary to change the temperature to the set point temperature. This is a multiplication program which implements the formula for kilowatts given above. The kilowatt output is converted into a percentage of maximum power (3 kilowatts) to calculate the feedforward output $x_2$. In other words, the kilowatt output is converted into a digital number representing a value from 0 to 100% where 100% corresponds to 3 kilowatts.

While the invention has been particularly shown and described with reference to preferred embodiments thereof, it will be understood by those skilled in the art that other changes in form and details may be made therein without departing from the spirit and scope of the invention.

We claim:

1. An apparatus for the fluid processing of a photosensitive material comprising (a) a first platen having a cavity on one planar surface and a pair of ducts at opposite ends of said cavity penetrating said platen to provide fluid communication with said ends of said cavity;

(b) a second platen having a raised resilient pattern on one planar surface, said pattern being of overall length and width smaller than said first platen and minimally larger than said cavity on said first platen, said pattern further being of uniform elevation above said surface of said second platen, said raised pattern being aligned so as to urge a coated surface of a web into sealing contact with said planar surface of said first platen at the perimeter of said cavity to provide a processing chamber in which one wall of said chamber is provided by a photosensitive material-coated surface of said coated web, said chamber having provision for the flow of processing chemicals;

(c) means, comprising a plurality of pneumatic cylinders, for urging said second platen against a fixed first platen, said second platen being in contact with an uncoated surface of said web and said cavity containing surface of said first platen being in contact with a coated surface of said web;

(d) a microwave heating unit, the output from which is controllable within ±1° C. from 20° to 60° C., comprising means for measuring temperature before and after a control point and for measuring flow rate, a source of microwave energy to provide thermal energy at said control point, and a programmed digital computer to provide forward and backward feedback control of said microwave source based on said temperatures and flow rate;

(e) means for transporting processing chemicals between a source, said heating unit, said processing chamber, and a waste drain; and (f) a computer supervised process monitor and controller.

* * * * *